US005634406A

United States Patent [19]

Lindner et al.

[11] Patent Number: 5,634,406

[45] Date of Patent: Jun. 3, 1997

[54] METHOD FOR AUTOMATICALLY FEEDING A PRINTING PLATE TO A PLATE CYLINDER IN A PRINTING MACHINE

[75] Inventors: Bernd Lindner; Nikola Pupic, both of Heusenstamm; Berthold Seib, Rodgau, all of Germany

[73] Assignee: MAN Roland Druckmaschinen AG, Germany

[21] Appl. No.: 551,349

[22] Filed: Nov. 1, 1995

[30] Foreign Application Priority Data

Nov. 5, 1994 [DE] Germany ..... 44 39 623.6

[51] Int. Cl.[6] ..... B41L 3/02

[52] U.S. Cl. ..... 101/486; 101/477; 101/DIG. 36

[58] Field of Search ..... 101/378, 382.1, 101/383, 477, 415.1, DIG. 36, 484, 485, 486; 33/614, 617, 618, 619, 621

[56] References Cited

U.S. PATENT DOCUMENTS

| | | | |
|---|---|---|---|
| 5,111,744 | 5/1992 | Wieland | 101/415.1 |
| 5,320,041 | 6/1994 | Maejima et al. | 101/415.1 |
| 5,394,614 | 3/1995 | Lindner et al. | 101/415.1 |
| 5,479,859 | 1/1996 | Lindner et al. | 101/485 |

FOREIGN PATENT DOCUMENTS

| | | |
|---|---|---|
| 0 551 976 A1 | 7/1993 | European Pat. Off. . |
| 0 581 212 A1 | 2/1994 | European Pat. Off. . |
| 35 27 103 A1 | 10/1986 | Germany . |
| 39 40 796 C2 | 9/1991 | Germany . |
| 42 26 780 A1 | 2/1994 | Germany . |

*Primary Examiner*—Ren Yan

*Attorney, Agent, or Firm*—Leydig, Voit & Mayer, Ltd.

[57] ABSTRACT

A method for automatically feeding a printing plate in proper registry to a plate cylinder in a printing machine is disclosed. Pursuant to the disclosed method, a printing plate is advanced by a plate conveyor towards a clamping rail on the plate cylinder. After the leading edge is inserted into the clamping rail, the in-register condition of the leading edge of the printing plate is independently sensed at two sensing sites. If the leading edge of the printing plate is in register at only one site, the printing plate is released from the plate conveyor for a period of time to permit the printing plate to align itself. The printing plate is then held again by the plate conveyor and the advancement of the plate is resumed. This process is repeated until the independent sensors both indicate that registry has been achieved.

4 Claims, 3 Drawing Sheets

METHOD FOR AUTOMATICALLY FEEDING A PRINTING PLATE TO A PLATE CYLINDER IN A PRINTING MACHINE

FIELD OF THE INVENTION

The invention relates generally to printing machines, and more particularly to a method for automatically feeding a printing plate in proper registry to a plate cylinder in a printing machine.

BACKGROUND OF THE INVENTION

In rotary printing machines, and especially in sheet-fed offset printing machines having a plurality of printing units, replacing printing plates can be considerably time-consuming. In order to reduce the machine shutdown time needed for setting the printing machine for a new printing job, automatic printing plate exchange devices have been developed in the past. In those automatic printing plate exchange devices, the procedure for feeding a new printing plate is performed automatically via drive means. Generally the feeding procedure begins by removing the new printing plate from a standby position and introducing it into the opening of a clamping rail on the plate cylinder. The leading edge of the printing plate is then clamped in the clamping rail, and the plate cylinder is rotated in the forward direction for approximately one revolution until the trailing end of the printing plate can be gripped by a clamping and tensioning device on the plate cylinder.

When a new printing plate is inserted into the opening of the clamping rail, it is particularly important for the leading edge of the printing plate to assume an in-register position before the clamping rail is closed to secure the leading end of the plate on the plate cylinder. A sheet-fed offset machine typically uses a plurality of printing plates to produce one print. Even if only one of the printing plates is not attached to its associated plate cylinder properly, complex register correction operations have to be carried out to put the printing plate in registry. Thus, if an automatic plate feeding method does not guarantee in-register mounting of printing plates on plate cylinders, the time saved by using the automatic feeding method can be outweighed by the time and effort spent in performing the register correction operations.

German Patent DE 3 940 796 C2 discloses a method and device for the automatic exchange of printing plates. In the method disclosed in this reference, position detection means is used to establish the in-register condition of the leading edge of the printing plate in the opening of the clamping rail. The leading end of the printing plate is clamped in the clamping rail after the leading edge of the printing plate is detected to have assumed an in-register position. As disclosed in this reference, the printing plate being fed to the clamping rail is held between a transporting roller and a back-pressure roller. The transporting roller is driven to advance the printing plate to the clamping rail. If the position detection means indicates that the leading edge of the printing plate is not in an in-register position, the transportation roller will be actuated and the printing plate will be advanced. The steps of position detection and plate advancement are repeated several times until registration occurs or, if the in-register position of the leading edge of the printing plate still does not occur after a number of attempts, the feeding operation is aborted. The disadvantage of this method is that the printing plate may be introduced into the clamping rail with too great a force thereby causing damage to the printing plate or to the other components of the press.

European Patent 0 581 212 A1 discloses an electrical register control which utilizes register pins arranged in the clamping rail for clamping the leading end of the printing plate on the plate cylinder. The register pins are spaced apart in the axial direction of the plate cylinder and are arranged to be electrically insulated from the plate cylinder and the clamping rail. The leading edge of the printing plate has U-shaped notches which are designed to abut the register pins when the plate is in the in-register position. The in-register condition of the plate can be established by detecting the formation of an electrically conducting contact between the electrically conductive leading edge of the printing plate and the register pins. In this reference, the register pins are electrically connected in series. As a result, an electrical connection will only occur when both register pins contact the leading edge of the printing plate, and, therefore, the position of the plate is only detected when both of the U-shaped notches on the leading edge of the plate abut the register pins at the same time. The disadvantage of this arrangement is that unless the printing plate contacts both register pins at the same time (i.e., it is in registry), there is no way to tell whether the leading edge of the plate is not making contact with either register pin, or whether the plate has been introduced obliquely so that it is making contact with only one of the register pins. In the latter case there is also no way to tell which pin is in contact with the leading edge of the plate. German Patent DE 3 527 103 A1 discloses a device for setting the position of a printing plate on a plate cylinder after the plate has been mounted on the plate cylinder. That device has three block-shaped mechanical impact probes disposed on circumference of the plate cylinder. Each impact probe cooperates with a rectangular register hole in the front-end region of the printing plate in such a manner that when a predefined side of the register hole contacts the impact probe, an associated indicator light or an LED is switched on to indicate the formation of the contact. This arrangement can be used to establish the in-register position of a printing plate which is already mounted on the plate cylinder. It is, however, not related to the automatic feeding of printing plates.

German Patent DE 4 226 780 A1 discloses the use of register pins in a device for controlling the in-register positioning of a printing plate on a plate cylinder. The register pins are electrically insulated from the plate cylinder. With such an arrangement, it is possible to establish the in-register condition of the front edge of a printing plate at two axially-separated sites in the clamping rail. In the device disclosed in this reference, each register pin generates an in-register signal when it is in contact with the leading edge of the printing plate. The in-register signal is received by means of a sensing probe which is arranged to contact a contact surface on the register pin.

European Patent 0 551 976 A1 discloses the use of register pins which are electrically insulated from the plate cylinder on which the register pins are disposed. In the European Patent 0 581 212 A1 described above, such register pins are arranged to cooperate with U-shaped notches on the leading edge of the printing plate to generate in-register signals. Because the register pins are electrically connected in series, the position of the printing plate is detected only when the leading edge of the printing plate is in contact with both register pins.

OBJECTS OF THE INVENTION

Accordingly, it is a general object of the present invention to provide an improved method for automatically feeding a printing plate into a printing machine. It is a further object of the invention to provide an improved method for automatically positioning a printing plate in a printing machine that guarantees registry.

It is another object of the invention to provide an improved method for automatically securing a printing plate in a printing machine which avoids applying excessive force to the printing plate. It is a related object to provide such an automatic feeding method which will not cause damage to the printing plate or the printing machine by applying excessive force.

It is still another object of the invention to provide an improved method for automatically securing a printing plate to a printing machine wherein the registration condition of either side of the plate can be detected independently.

It is yet another object to provide an improved method for automatically securing a printing plate to a printing machine which utilizes the weight of the printing plate to achieve registration.

SUMMARY OF THE INVENTION

The present invention accomplishes these objectives and overcomes the problems of the prior art by providing a method for automatically feeding a printing plate to a plate cylinder in a printing machine having a clamping rail associated with the plate cylinder for clamping the leading edge of the printing plate. The method comprises the steps of: (a) securing the printing plate on a plate conveyor; (b) actuating the plate conveyor to advance the printing plate toward the clamping rail; (c) sensing the in-register condition of the leading edge of the printing plate at two independent sensing sites in the clamping rail; (d) releasing the printing plate from the plate conveyor for a predefined period of time if the leading edge of the printing plate is sensed to be in registry at only one of the two sensing sites to permit the printing plate to change its orientation under its own weight; (e) sensing the printing plate on the plate conveyor; (f) re-actuating the plate conveyor to resume the advancement of the printing plate; and (g) repeating steps (c) through (f) until the in-register condition of the leading edge of the printing plate is sensed at both sensing sites.

These and other features and advantages of the invention will be more readily apparent upon reading the following description of the preferred embodiment of the invention and upon references to the accompanying drawings wherein:

DETAILED DESCRIPTION OF THE PREFERRED EMBODIMENT

Figure 2:
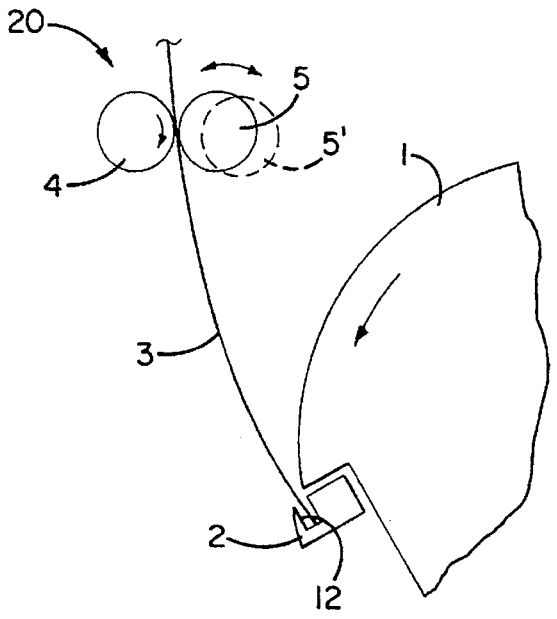
FIG. 2 is a schematic drawing illustrating a plate conveyor feeding a printing plate into a clamping rail on a plate cylinder.

FIG. 2 shows generally a portion of a printing machine operating in accordance with the teachings of the instant invention. The printing machine includes a plate cylinder 1 and a clamping rail 2. The clamping rail 2 is arranged on the circumference of the plate cylinder 1 in a groove which is parallel to the longitudinal axis of the plate cylinder 1. The clamping rail 2, which is designed to hold the leading edge of the printing plate 3, extends over the format width of the plate cylinder 1. As shown in FIG. 2, the clamping rail 2 has a gripping region 12 which can be opened and closed and into which the leading edge of a printing plate 3 can be inserted. During the feeding operation, the printing plate 3 is releasably held by a plate conveyor 20, which is driven to advance the printing plate 3 toward the clamping rail 2. When appropriate, the plate conveyor 20 can release the printing plate 3. The present invention can be implemented in printing machines of widely ranging types and with different types of plate conveyors. In the illustrated embodiment, the plate conveyor comprises a plurality of roller pairs. It will be appreciated by those skilled in the art, however, that other types of plate conveyors can be used without departing from the scope or spirit of the invention. For example, conveyors which use air suction to hold the printing plate, such as a suction belt, can be used to transport the printing plate. In such a case, the printing plate can be released from the conveyor by turning off the air suction.

As mentioned above, the plate conveyor in the illustrated embodiment comprises two or more pairs of rollers. Each pair of rollers comprises a back-pressure roller 4 and a transporting roller 5. Although for simplicity of illustration, only one pair of rollers 4, 5 is shown in FIG. 2, the roller pairs are preferably divided into two or more groups which are spaced apart in the axial direction of the plate cylinder. The following description of the operation of the transporting roller 5 and back-pressure roller 4 applies to all roller pairs in the plate conveyor 20.

The rotational axes of both the transporting roller 5 and the back-pressure roller 4 are arranged parallel to that of the plate cylinder 1. The rotational axis of the back-pressure roller 4 is designed to be fixed on the frame of the printing machine. The transporting roller 5, on the other hand, is provided with a pivotable suspension known in the art. By means of the pivotable suspension, the transporting roller 5 can assume an engaged position in which it is engaged with a slight pressure against the back-pressure roller 4 and a disengaged position in which it is separated from the back-pressure roller 4. The disengaged position of the transportation roller 5 is shown in dashed lines in FIG. 2. The transporting roller 5 is provided with any of a number of known actuation devices for selectively positioning the transporting roller 5 in either of the two positions. The printing plate 3 is located between the transporting roller 5 and the back-pressure roller 4 and is held by the pressure between the two rollers when the transporting roller 5 is in its engaged position. The printing plate 3 is advanced to the clamping rail 2 by rotating the transporting roller 5. Preferably, the transporting roller 5 is arranged to contact the back side of the printing plate 3 so that any slipping between the printing plate 3 and the transporting cylinder 5 will not cause damage to the printing surface of the printing plate 3. When the transporting roller 5 is moved to the disengaged position, the printing plate 3 is released from the plate conveyor 20 and is allowed to slide on the back-pressure roller 4.

Figure 3:
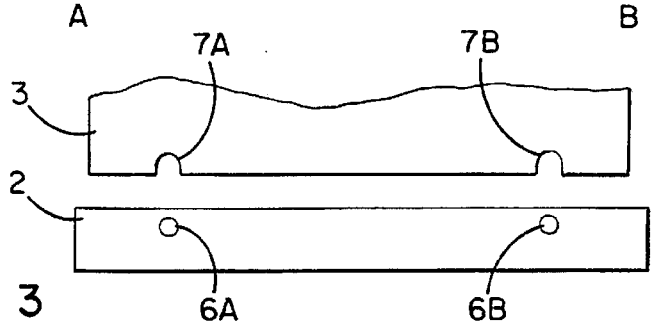
FIG. 3 is a schematic drawing of the leading edge of a printing plate and a clamping rail showing the printing plate approaching the clamping rail.

In accordance with the teachings of the invention, the position of the leading edge of the printing plate 3 is monitored at two separate sensing sites in the clamping rail 2 to determine whether the printing plate 3 has assumed an in-register position. The in-register condition at each sensing site is sensed independently of the other sensing site. In the preferred embodiment, the sensing of the in-register condition is accomplished by using two register pins 6A and 6B disposed on the clamping rail 2 and two corresponding notches 7A and 7B on the leading edge of the printing plate 3. As shown in FIG. 3, the register pins 6A and 6B are spaced apart in the axial direction of the plate cylinder 1. The notches 7A and 7B on the leading edge of the printing plate 3 are arranged in such a manner that they abut the register pins 6A and 6B when the leading edge of the printing plate 3 assumes an in-register position. The register pins 6A and 6B are electrically insulated from both the clamping rail 2 and plate cylinder 1. However, the leading edge of the plate 3 adjacent notches 7A and 7B is electrically conductive. Then, when either notch 7A or 7B abuts its corresponding register pin 6A or 6B, an electrical conducting path is formed therebetween. The formation of this electrical path at each sensing site can be sensed to determine whether the leading edge of the printing plate 3 is in registry. The register pins 6A and 6B are separately connected via electrical wires or keys to an electrical control current such as a microprocessor with appropriate input circuitry which senses the electrical conduction states of the register pins. Since the sensing sites are separately wired, an in-registry condition will only be detected by the control circuit when both sites are conductive. Preferably, the electrical control circuitry controls the entire automated plate exchange operation.

Figure 1:
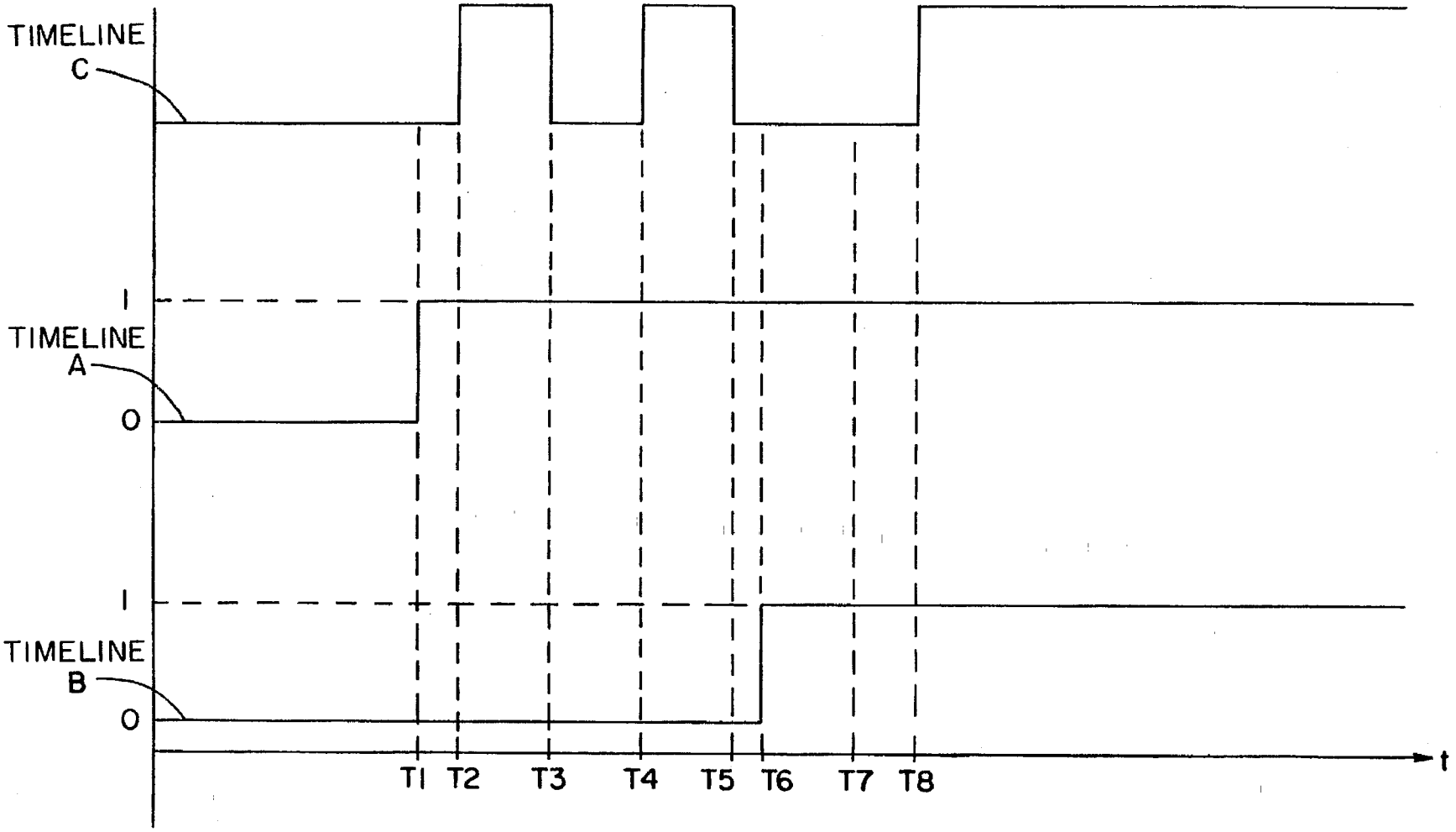
FIG. 1 shows the temporal sequence of the steps of sensing the in-register condition of a printing plate at two sensing sites and the operation of a plate conveyor in an exemplary case of a plate feeding operation performed in accordance with the teachings of the present invention.

The temporal sequence of the steps of sensing the conducting state of the register pins 6A and 6B as well as the operation of the plate conveyor in an exemplary feeding operation is illustrated in FIG. 1. The top timeline C indicates the operational states of the plate conveyor 20, with the upper state indicating that the transporting roller 5 (FIG. 2) is in the disengaged position and the lower state indicating that the transporting roller 5 is in the engaged position. The timelines A and B show the electrical conducting states of the register pins 6A and 6B (FIG. 3), respectively. The "1" state of the time-lines A and B indicates that the register pin 6A or 6B is in electrical contact with its corresponding notch in the printing plate 3, and the "0" state indicates that no electrical contact with the corresponding notch of the printing plate 3 is established.

Figure 4:
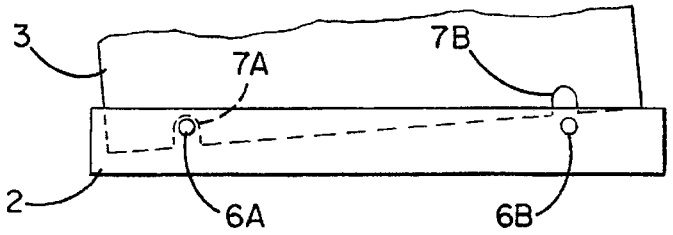
FIG. 4 is a schematic drawing similar to FIG. 3 but illustrating the printing plate in an oblique position relative to the clamping rail.
Figure 5:
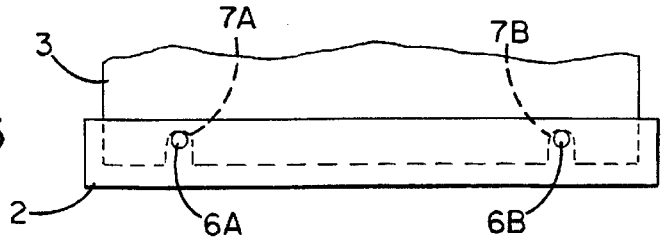
FIG. 5 is a view similar to FIGS. 3 and 4 but showing the printing plate and the clamping rail in registry; and, FIG. 6 is a block diagram representation of the method of the present invention.

The plate feeding operation illustrated in FIG. 1 corresponds to FIGS. 3–5. Thus, at the beginning of the process, the printing plate 3 and the clamping rail 2 have assumed the relative position illustrated in FIG. 3. At this point, the plate cylinder 1 has assumed a predefined plate feeding position and will remain stationary during the initial part of the plate feeding process. As shown in FIG. 3, the printing plate 3 is still at a distance from the gripping region 12 of the clamping rail 2 at this time. As shown in timeline C of FIG. 1, the transporting roller 5 is in its engaged position against the back-pressure roller 4 (FIG. 2) and, thus, the plate conveyor 20 is urging the printing plate 3 toward the clamping rail 2.

The leading edge of the printing plate 3 is introduced into the opening of the gripping region 12 of the clamping rail 2. In this example, it is assumed that due to certain influences such as different friction ratios, the printing plate 3 is introduced into the clamping rail 2 at a slight angle as shown in FIG. 4. As a result, the notch 7A comes into contact with the register pin 6A, but the notch 7B is still a small distance away from the register pin 6B. Due to its contact with the notch 7A, the register pin 6A assumes a "1" state at time T1 as shown in FIG. 1. The register 6B, on the other hand, stays in the "0" state since no contact between the notch 7B an the register pin 6A has yet been achieved.

After sensing that only one register pin 6A is in contact with the leading edge of the printing plate 3, the control circuitry disengages the transporting roller 5 from the back-pressure roller 4 at time T2, thereby releasing the holding pressure on the printing plate 3. If desired, the back-pressure roller 4 can remain free to rotate when the transporting roller 5 is in the disengaged position. Without the pressure exerted by the transporting roller 5, the printing plate 3 can assume a new orientation under its own weight.

After a predefined period of time, the control circuitry causes the transporting roller 5 to reengage (time T3), so that the printing plate 3 is again held between the transporting roller 5 and the back-pressure roller 4. The printing plate 3 is again advanced toward the clamping rail 2. In the example shown in FIG. 1, the plate advancement is aborted at time T4 because the printing plate 3 is still not in registry at register pin 6B as indicated by the "0" state of the register pin 6B. The transporting roller 5 is therefore again disengaged at the time T4 so that the printing plate 3 has another opportunity to align itself with both register pins 6A and 6B.

At time T5, the transporting roller 5 is once again engaged. At time T6, the notch 7B comes into contact with the register pin 6B. The conducting state of the register pin 6B correspondingly changes to the "1"state. In this example the register pin 6A and the notch 7A have remained in contact since the initial contact between those structures was formed. Thus, the printing plate 3 has attained registry as shown in FIG. 5.

Figure 6:
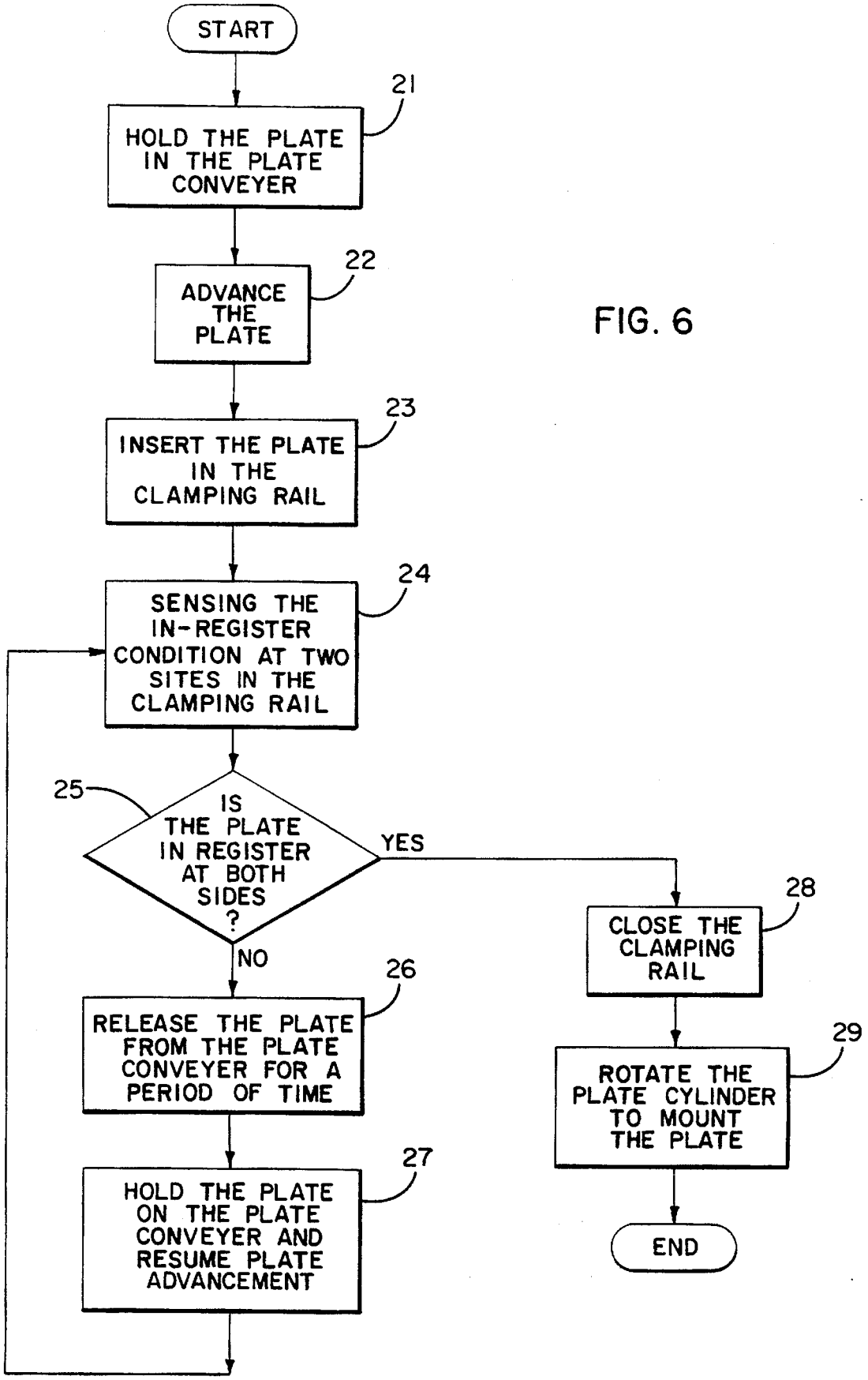

After the contacts between the printing plate 3 and both register pins 6A and 6B are established, the gripping region 12 of the clamping rail 2 is closed at the time T7 to clamp the leading edge of the printing plate 3 in position. As shown in FIG. 6, even after the contacts at both register pins 6A and 6B are achieved at time T6, the transporting roller 5 is still engaged and is still driven to apply an advancing force on the printing plate 3. Such an advancing force is preferably maintained on the printing plate 3 until time T8, which is shortly after the clamping rail 2 is closed (time T7). Thus, the leading edge of the printing plate 3 is held against the register pins 6A and 6B while the clamping rail 2 is closing to insure that the printing plate 3 remains in registry after the clamping rail 2 is closed. Since the transporting roller 5 acts on the printing plate 3 via frictional contact, slipping will occur between the printing plate 3 and the transporting roller 5 when the printing plate 3 can not move further. As a result, the advancing force on the printing plate 3 is limited so that neither the printing plate 3 nor the printing machine will be damaged in the feeding process. Those skilled in the art will appreciate that other means for limiting the advancing force on the printing plate 3, such as slip clutches, can be used without departing from the scope or the spirit of the invention.

After the printing plate 3 has been properly secured in the clamping rail 2, the transporting roller 5 can be disengaged from the back-pressure roller 4, and the drive mechanism of the transporting roller 5 can be disengaged. The plate cylinder 1 is then rotated in the forward direction so that the printing plate 3 is disposed on the circumference of the plate cylinder 1. The trailing end of the printing plate 3 is then secured in a well known manner in a clamping and tensioning device on the plate cylinder 2.

The method of the present invention for automatic plate feeding will be now be described generally in conjunction with FIG. 6, which shows in a flowchart format the steps of the inventive method. The new printing plate 3 to be fed to the plate cylinder 2 is initially held in a plate conveyor (step 21). The printing plate 3 is then advanced toward the clamping rail 2 of the plate cylinder 1 (step 22), and the leading edge of the printing plate 3 is inserted into the opening of the clamping rail 2 (step 23). The in-register condition of the leading edge of the printing plate 3 is then sensed at two axially separated sites in the clamping rail 2 (step 24) by interrogating two separately wired sensors to determine whether the leading edge of the printing plate 3 is in register at both sites (step 25). If the in-register condition is established at both sites, the clamping rail 2 is closed to secure the leading edge of the printing plate 3 on the plate cylinder 1 (step 28). Subsequently, the plate cylinder 1 is rotated in the forward direction until the trailing edge of the printing plate 3 can be secured by a gripping and tensioning device on the plate cylinder 1, thereby completing the process of mounting the printing plate 3 on the plate cylinder 1 (step 29).

If it is detected in step 25 that the leading edge of the printing plate 3 is in register at only one sensing site, the plate conveyor 20 releases the printing plate 3 from the plate conveyor for a short predefined period of time (step 26). The printing plate 3 which is no longer held firmly by the plate conveyor then has an opportunity to assume a new orientation under its own weight. After the predefined period of time the plate conveyor 20 is reengaged to secure the printing plate 3 and the advancement of the printing plate 3 is resumed (step 27). The steps 24–27 are then repeated until the leading edge of the printing plate 3 is sensed to be in register at both sensing sites, in which case steps 28 and 29 will be carried out to complete the plate mounting process.

It will now be appreciated that an improved method for the automatic feeding of a printing plate to a clamping rail on a plate cylinder in a printing machine has been provided. According to the method, the in-register condition of the leading edge of the printing plate within the clamping rail is independently sensed at two separate sensing sites. Because of this arrangement, it is possible to determine whether the leading edge of the printing plate is partially in register or not in register at all. If the leading edge of the printing plate is engaged at only one sensing site, the printing plate is released from the plate conveyor to permit the printing plate to adjust its position under its own weight. This step of self-alignment reduces the risk of damaging the printing plate by over-stressing the printing plate during the plate feeding process. The printing plate is then held by the plate conveyor again and the advancement of the printing plate is resumed. Once the printing plate is in-register at both sensing sites the plate is clamped by the clamping rail 2 and the trailing edge of the plate is subsequently secured in a manner known in the art.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. A method for automatically feeding a printing plate in proper registry to a plate cylinder in a printing machine, the printing machine having a clamping rail associated with the plate cylinder for clamping the leading edge of the printing plate, the method comprising the steps of:

(a) securing the printing plate on a plate conveyor;

(b) actuating the plate conveyor to advance the printing plate toward the clamping rail;

(c) sensing the in-register condition of the leading edge of the printing plate at two independent sensing sites in the clamping rail;

(d) releasing the printing plate from the plate conveyor for a predefined period of time if the leading edge of the printing plate is sensed to be in registry at only one of the two sensing sites to permit the printing plate to change its orientation under its own weight;

(e) securing the printing plate on the plate conveyor after the predefined period has passed to resume the advancement of the printing plate;

(f) repeating steps (c) through (e) until the in-register condition of the leading edge of the printing plate is sensed at both sensing sites; and, (g) clamping the leading edge of the printing plate in the clamping rail after the in-register condition is sensed.

2. A method as defined in claim 1, wherein the step of clamping clamps the leading edge of the printing plate in the clamping rail while the plate conveyor is advancing the printing plate and after the in-register condition of the leading edge of said printing plate is established at both sensing sites.

3. The method as defined in claim 1, wherein the plate conveyor includes a plurality of pairs of rollers, each of the pairs of rollers comprising a back-pressure roller and a transporting roller, the transporting roller having an engaged position in which the transporting roller engages the back-pressure roller and a disengaged position in which the transporting roller is disengaged from the back-pressure roller.

4. The method as defined in claim 1, wherein the sensing is independently performed by two register pins disposed in the clamping rail and two corresponding notches formed in the leading edge of the printing place, each of the two register pins being connected to a control circuit to independently form an electrically conducting path upon contacting its corresponding notch on the printing plate.

* * * * *